US005097398A

United States Patent [19]

Dye

[11] Patent Number: 5,097,398

[45] Date of Patent: Mar. 17, 1992

[54] DECORATIVE LIGHTING AND ROTATING DISPLAY FIXTURE

[76] Inventor: David Dye, 3541 High Countryside Dr., Grapevine, Tex. 76051

[21] Appl. No.: 617,164

[22] Filed: Nov. 23, 1990

[51] Int. Cl.[5] ..... F21S 1/06

[52] U.S. Cl. ..... 362/147; 362/124; 362/149; 362/808

[58] Field of Search ..... 362/35, 124, 145, 147, 362/148, 277, 806, 808, 149

[56] References Cited

U.S. PATENT DOCUMENTS

| | | | |
|---|---|---|---|
| D. 84,648 | 7/1931 | Primakow | D26/59 |
| D. 101,479 | 10/1936 | Kisling | D26/59 |
| D. 150,286 | 7/1948 | Asch | D26/51 |
| 1,192,585 | 7/1916 | Treconing | 362/35 |
| 1,380,135 | 5/1921 | Corbin | 362/96 |
| 2,092,520 | 9/1937 | Nielsen | 362/124 |
| 2,772,348 | 11/1956 | Moss | 362/124 |
| 4,064,427 | 12/1977 | Hansen et al. | 362/96 |
| 4,146,919 | 3/1979 | Jennings | 362/35 |
| 4,214,296 | 7/1980 | Megett | 362/147 |
| 4,342,073 | 7/1982 | Ranten | 362/147 |
| 4,356,535 | 10/1982 | Chu | 362/35 |
| 4,382,400 | 5/1983 | Stutzman | 98/40 |
| 4,402,649 | 9/1983 | Laurel | 416/5 |
| 4,528,620 | 7/1985 | Weber | 362/147 |
| 4,626,970 | 12/1986 | Huang | 362/147 |
| 4,685,038 | 8/1987 | Huang | 362/147 |
| 4,989,120 | 1/1991 | Davis et al. | 362/35 |
| 4,996,633 | 2/1991 | Fu | 362/35 |

*Primary Examiner*—Ira S. Lazarus
*Assistant Examiner*—Sue Hagarman
*Attorney, Agent, or Firm*—Harold E. Meier

[57] ABSTRACT

A decorative lighting and rotating display fixture kit comprises a support frame for mounting the fixture to a ceiling fan, a shroud concealing the support frame, and at least one electrical light socket mounted within the shroud. A motor is mounted to extend below the support frame shroud, is concealed by a decorative motor shroud, and supports a decorative display or carousel for rotation about a vertical axis. Electrical wiring connects the light socket and the motor to the ceiling fan wiring. A switch attached to the support frame and connected to the electrical wiring controls electrical energy to the fixture kit. The fixture kit may be mounted directly to the ceiling or other wiring location as a separate fixture, without the ceiling fan.

14 Claims, 4 Drawing Sheets

DECORATIVE LIGHTING AND ROTATING DISPLAY FIXTURE

TECHNICAL FIELD

This invention relates generally to decorative lighting fixture kits and more specifically to a decorative lighting and rotating display fixture for use alone or as a kit for use with a ceiling fan.

BACKGROUND OF THE INVENTION

In recent years, ceiling fans have become highly popular for both commercial and residential uses for functional, as well as decorative purposes. Most, if not all, ceiling fan models are adapted for attachment of a lighting fixture kit suspended below the blade portion of the fan. Such lighting fixture kits have historically included a single bulb socket with a globe cover, multiple exposed bulb branches, and multiple sockets with individual globe covers. Historically, such ceiling fan lighting fixture kits have provided stationary lighting.

SUMMARY OF THE INVENTION

The present invention adds another dimension to existing ceiling fan lighting fixture kits by providing for decorative lighting and rotating decorative displays attached to the light kit adapter portion of the ceiling fan. A carousel or other decorative display is attached to a source of rotating power suspended by a support bracket from the adapter portion of the ceiling fan. The decorative display is provided with wiring for connection to the light adapter wiring of the ceiling fan to provide electrical power to the source for rotating the decorative display. Additionally, a shroud surrounds the support bracket and is equipped with light sockets also connected to the adapter wiring of the fan. A switch controls the electrical power to the light sockets and to the source for rotation of the decorative display.

The decorative lighting and rotating display fixture may be used as a kit for attachment to the light adapter of a ceiling fan or may be installed alone as a separate lighting fixture. When used as a separate fixture, the support bracket is mounted directly to the ceiling or other lighting support and the wiring in the fixture is connected directly to the local wiring.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION OF THE INVENTION

Figure 1:
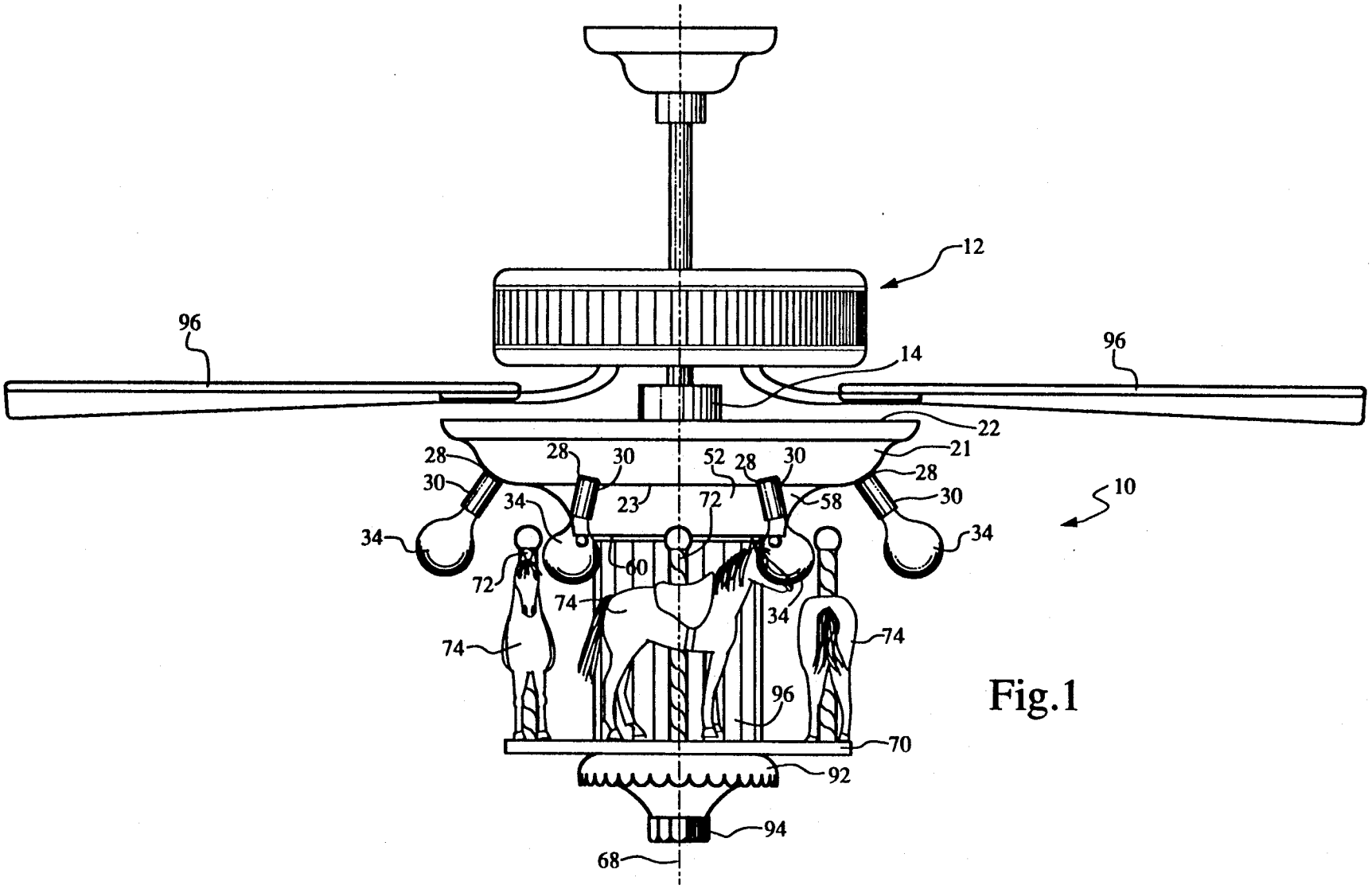
FIG. 1 is a perspective view of a decorative lighting and rotating display fixture of the present invention.
Figure 2:
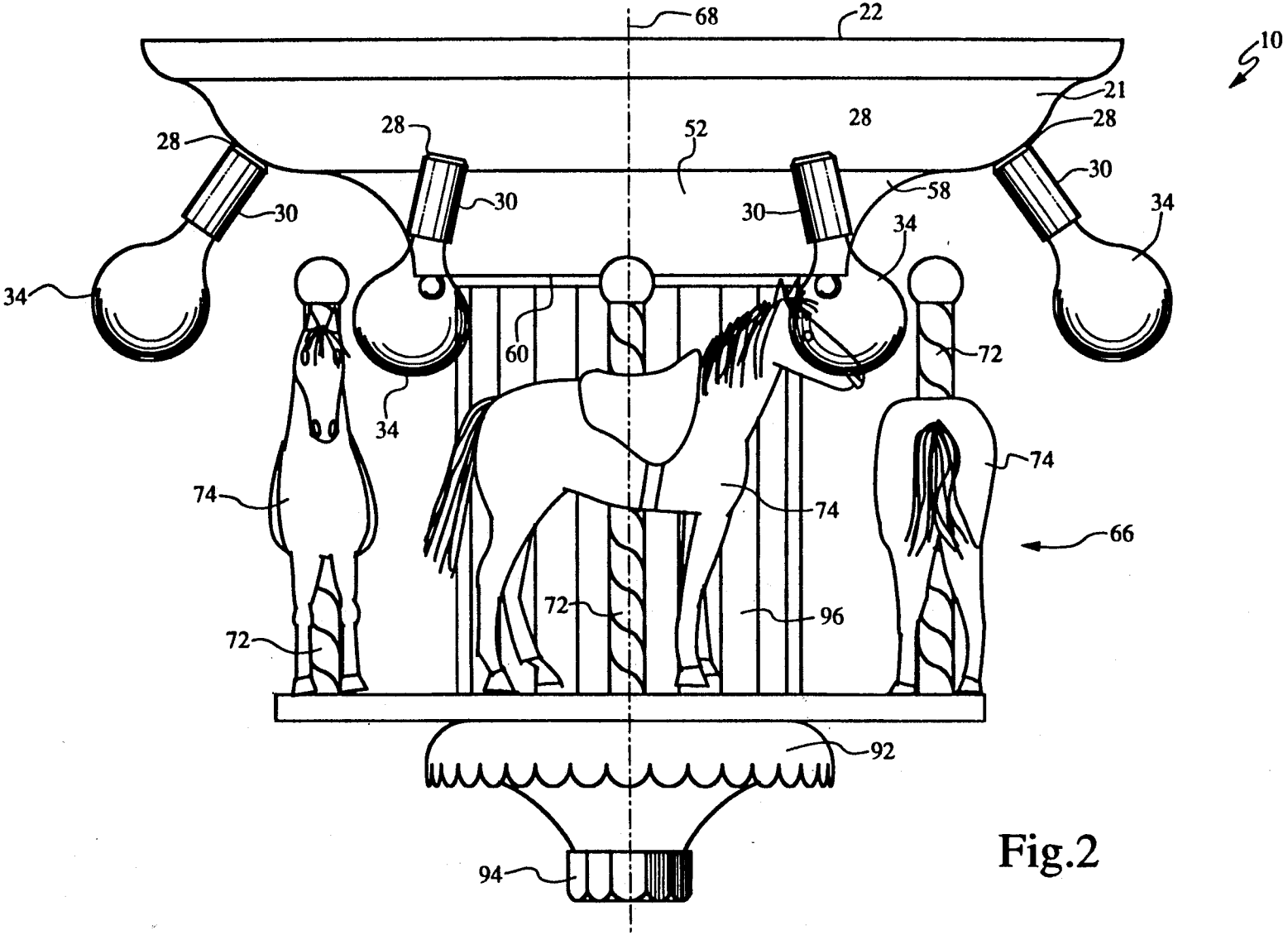
FIG. 2 is an enlarged front view of the fixture of FIG. 1.
Figure 3:
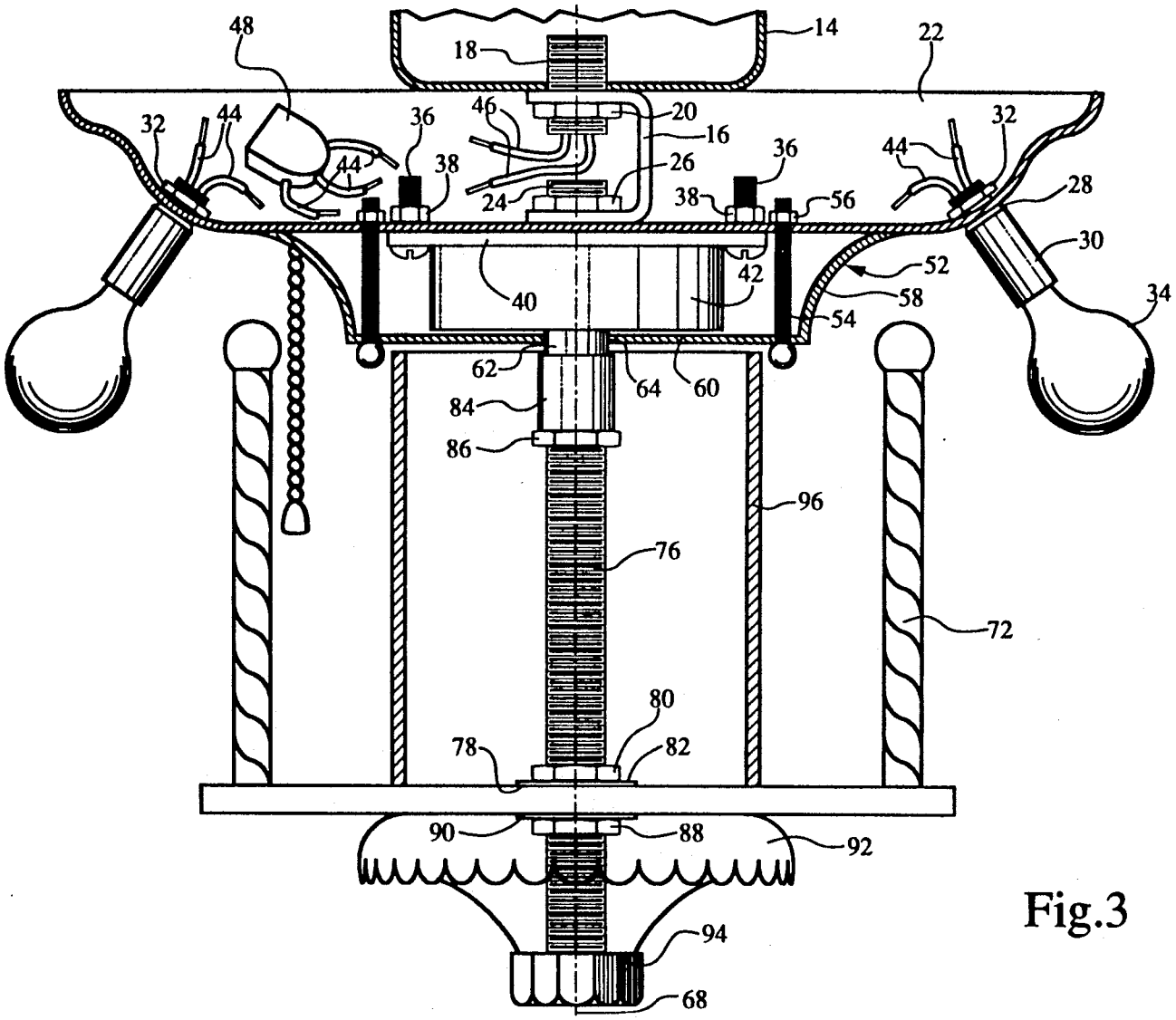
FIG. 3 is an enlarged partial sectional view of the fixture of FIG. 1.

Referring now to the drawings and inparticular to FIGS. 1, 2 and 3 thereof, there is shown a decorative lighting and rotating display fixture kit 10 incorporating the present invention. The fixture kit 10 is attached to and suspended from a conventional ceiling fan 12, specifically the light adapter 14 of the fan 12. The fixture kit 10 is attached to the light adapter 14 of the fan 12 by a support frame 16 secured to the light adapter 14 through use of conventional threaded pipe 18 and hex nut 20. A decorative shroud 22 surrounds the support frame 16 and is secured thereto with a conventional threaded pipe 24 and hex nut 26.

The decorative shroud 22 has a perimeter wall 21 and a bottom wall 23. A plurality of openings 28 are provided in the perimeter wall 21 of the shroud 22 for attachment of light sockets 30 thereto such that light bulbs 34 inserted into the light sockets 30 extend outwardly and downwardly from the decorative shroud 22. Hex nuts 32 secure the light sockets 30 in the openings 28 in the housing 22.

Attached to the bottom wall 23 of the decorative shroud 22 by conventional bolts 36 and nuts 38 is a plate 40 with a motor 42 attached thereto and extending downwardly therefrom. The motor 42 is a conventional 110 v electric motor. Electrical wiring 44 connects the motor 42 and the light sockets 30 to electrical wiring 46 of the fan. A switch 48 is mounted in the perimeter side wall 21 of the decorative shroud 22 and is connected to the electrical wiring 44 and 46 for controlling the flow of electrical energy to the light sockets 30 and the motor 42. The wiring 44 for the motor 42 passes through an opening 50 in the bottom wall 23 of the decorative shroud 22 for connection with the switch 48.

A decorative shroud 52 surrounds the motor 42 and is attached to the decorative shroud 22 through use of conventional bolts 54 and nuts 56 (only one shown). As with the shroud 22, the decorative shroud 52 has a perimeter wall 58 and a bottom wall 60. The shaft 62 of the motor 42 extends downwardly through an opening 64 in the bottom wall 60. The decorative display or carousel portion 66 of the fixture kit 10 is attached to the motor shaft 62 and extends downwardly for rotation about a vertical axis 68.

The carousel portion 66 of the fixture 10 has a base plate 70 with upper and lower surfaces and may be made of any rigid material including reflective glass or metal. A plurality of figure supports 72 are attached at spaced apart intervals along the upper surface of the base plate 70 and extend in a generally upward direction parallel to the rotational axis 68. Carousel FIGS. 74, that may include animal figures, human figures, floral figures, or any other desired decorative item, may be attached to the figure supports 72.

The base plate 70 is attached to the motor shaft 62 and is vertically positioned through use of a threaded nipple 76 extending through an opening 78 in the base plate 70 and secured thereto by a lock nut 80 and washer 82. The threaded nipple 76 is secured to the motor shaft 62 by a coupling 84 and lock nut 86.

The threaded nipple 76 extends through the opening 78 in the base plate 70 where it is secured in position with a lock nut 88 and washer 90. A decorative cover 92 surrounds and conceals that portion of the threaded nipple 76 extending through the base plate 70 and is secured in position through use of a decorative lock nut 94. That portion of the threaded nipple 76 extending between the attachment point to the motor shaft 62 and the base plate 70 is enclosed within a generally cylindrically shaped reflective cover 96.

Upon actuation of the switch 48 the light bulbs 34 are illuminated and the motor 42 provides power for turning the motor shaft 62, thereby rotating the carousel portion 66 of the fixture 10. The fan may be operated alone or with the decorative lighting of the fixture kit illuminated and/or with the decorative display or carousel rotating. Depending upon the wiring of the specific model fan, the fixture kit 10 may be illuminated and the carousel rotated without the blades 96 of the fan 12 turning. In addition to attaching the fixture kit 10 to a ceiling fan, the fixture kit may be mounted alone at any location for connection to electrical wiring to function as a separate decorative lighting and rotating display fixture.

Figure 4:
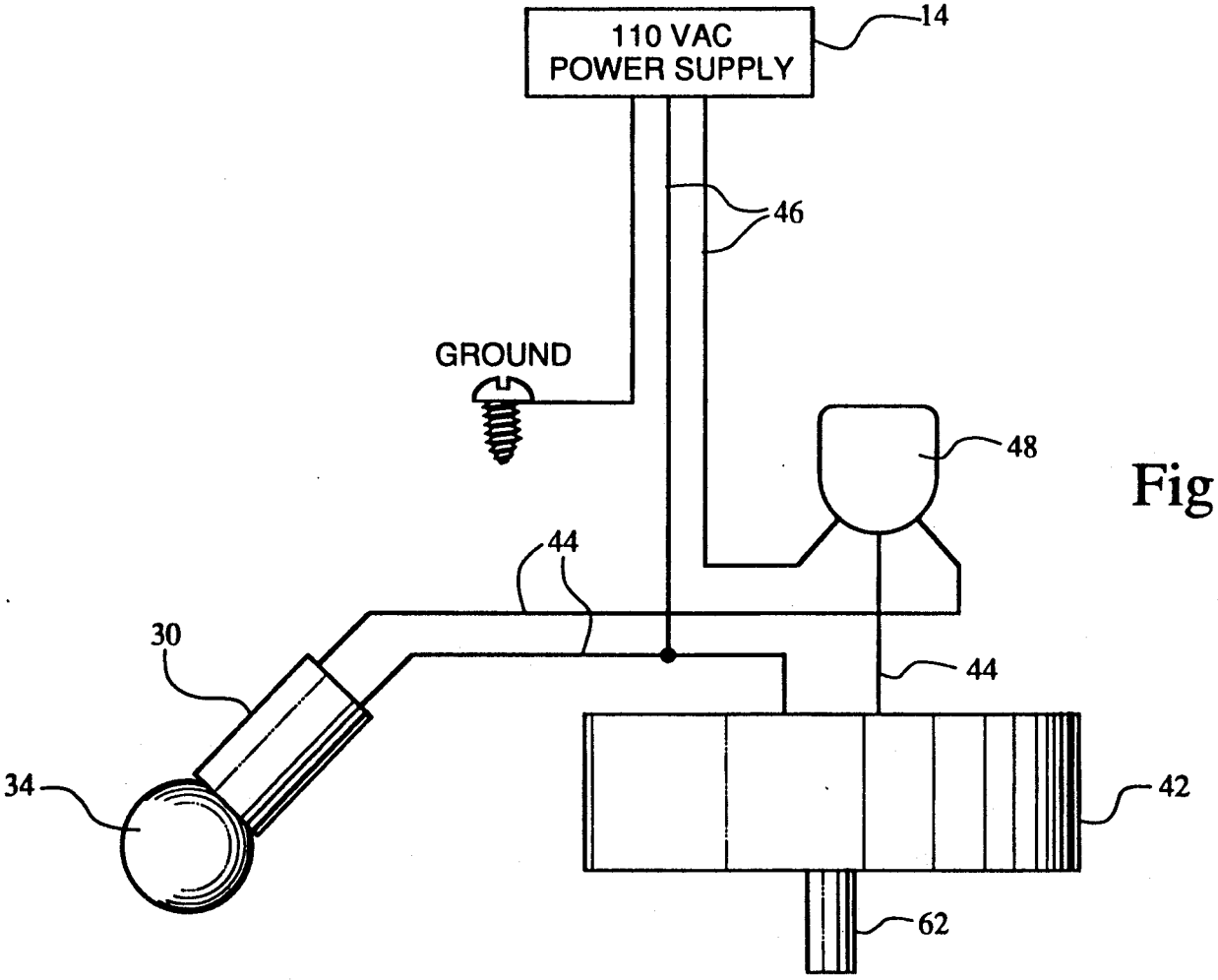
FIG. 4 is a schematic drawing of the electrical diagram of the present invention.

Referring now to FIG. 4, there is shown a schematic drawing of the electrical circuit for the decorative lighting and rotating display fixture kit 10 of the present invention. As illustrated, the switch 48 controls the flow of electric energy from the electrical wiring 46 through the electrical wiring 44 to the light sockets 30 and the motor 42 for illumination of the light bulbs 34 and rotation of the motor shaft 62 of the carousel portion 66 of the fixture kit 10. The switch 48 is preferably a conventional four way switch.

Although a preferred embodiment of the invention has been illustrated in the accompanying drawings and described in the foregoing detailed description it will be understood that the invention is not limited to the embodiment disclosed, but is capable of numerous rearrangements and modifications of parts and elements without departing from the spirit of the invention.

What is claimed is:

1. Decorative lighting comprising:

a support frame;

a shroud attached to and surrounding the support frame;

at least one electrical light socket mounted in the shroud and extending outwardly therefrom;

a motor mounted to the support frame and extending downwardly therefrom;

a decorative display mounted to the motor and extending downwardly therefrom, said decorative display comprising:

a base plate;

a plurality of figure supports attached at spaced apart intervals to and extending from the base plate;

at least one decorative figure mounted on each of the figure supports; and mounting means attached to the shaft of said motor and extending through and attached to said base plate for rotation of said base plate; and wiring means for transmitting electrical energy to the light socket and the motor.

2. The decorative lighting of claim 1, further comprising a decorative cover surrounding said mounting means and having a substantially cylindrical shape with a reflective surface.

3. The decorative lighting of claim 1, further comprising a decorative cover mounted below said base plate enclosing that portion of said mounting means extending through said base plate.

4. The decorative lighting of claim 1, further comprising a motor shroud attached to said support frame shroud and enclosing said motor.

5. The decorative lighting of claim 1, wherein the support frame includes mean for mounting to a ceiling fan having a light adapter and light adapter wiring.

6. The decorative lighting of claim 5, wherein the wiring means is connected to the light adapter wiring of the ceiling fan.

7. Decorative lighting comprising:

a support frame;

a shroud attached to and surrounding the support frame and having at least one opening therein;

at least one electrical light socket mounted in said opening in said shroud and extending outwardly therefrom;

a motor mounted to said support frame and extending downwardly therefrom;

a motor shroud attached to said support frame shroud and enclosing said motor;

a decorative display comprising:

a base plate;

a plurality of figure supports attached at spaced apart intervals to and extending upwardly from said base plate;

at least one decorative figure mounted on each of said figure supports; and mounting means attached to the shaft of said motor and extending through and attached to said base plate for rotation of said base plate; and wiring means for transmitting electrical energy to said light socket and said motor.

8. The decorative lighting of claim 7, further comprising a decorative cover mounted below said base plate enclosing that portion of said mounting means extending through said base plate.

9. The decorative lighting of claim 7, further comprising a cover surrounding said mounting means and having a substantially cylindrical shape with a reflective surface.

10. The decorative lighting of claim 7, wherein the support frame includes means for mounting to a ceiling fan having a light adapter and light adapter wiring.

11. The decorative lighting of claim 10, wherein the wiring means is connected to the light adapter wiring of the ceiling fan.

12. Decorative lighting kit for use with a ceiling fan comprising:

a support frame;

a support frame shroud attached to and surrounding said support frame and having a bottom wall and a perimeter wall;

at least one opening in the perimeter wall of said shroud;

at least one electrical light socket mounted in said opening in said support frame shroud and extending outwardly therefrom;

a motor mounted to said support frame and extending downwardly therefrom;

a motor shroud attached to said support frame shroud and enclosing said motor;

a decorative display extending downwardly from said motor comprising;

a base plate;

a plurality of figure supports attached at spaced apart intervals to and extending upwardly from said base plate;

at least one figure mounted on each of said figure supports;

mounting means attached to the shaft of said motor and extending through and attached to said base plate for rotation of said base plate; and a cover surrounding said mounting means; and wiring means for transmitting electrical energy to said light socket and said motor.

13. The decorative lighting kit of claim 12, further comprising a decorative cover mounted below said base plate enclosing that portion of said mounting means extending through said base plate.

14. The apparatus of claim 12, wherein the cover surrounding said mounting means has a substantially cylindrical shape with a reflective surface.

* * * * *